US008330696B2

(12) United States Patent
Cho et al.

(10) Patent No.: US 8,330,696 B2
(45) Date of Patent: Dec. 11, 2012

(54) DRIVING METHOD OF LIQUID CRYSTAL DISPLAY DEVICE

(75) Inventors: Hyung-Nyuck Cho, Incheon (KR); Chang Il Ryoo, Seoul (KR); Hae-Yeol Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 579 days.

(21) Appl. No.: 12/568,128

(22) Filed: Sep. 28, 2009

(65) Prior Publication Data

US 2010/0245225 A1 Sep. 30, 2010

(30) Foreign Application Priority Data

Mar. 26, 2009 (KR) ..... 10-2009-0025939

(51) Int. Cl.
*G09G 3/36* (2006.01)

(52) U.S. Cl. ..... 345/98; 345/690

(58) Field of Classification Search ..... None
See application file for complete search history.

(56) References Cited

U.S. PATENT DOCUMENTS

2009/0109247 A1 4/2009 Kimura

FOREIGN PATENT DOCUMENTS

CN 101420519 A 10/2008
CN 101420519 A 4/2009

OTHER PUBLICATIONS

Chinese Patent Office Action dated Jan. 13, 2012, with English translation.

*Primary Examiner* — Jason Olson
(74) *Attorney, Agent, or Firm* — Morgan, Lewis & Bockius LLP

(57) ABSTRACT

A driving method of a liquid crystal display device includes steps of providing image data to a liquid crystal panel each frame, providing an image-data gate driving signal to the liquid crystal panel and inputting the image data to the liquid crystal panel, providing black data to the liquid crystal panel, providing a black-data gate driving signal to the liquid crystal panel and inputting the black data to the liquid crystal panel, and delaying the black-data gate driving signal when each frame starts.

8 Claims, 5 Drawing Sheets

DRIVING METHOD OF LIQUID CRYSTAL DISPLAY DEVICE

This application claims the benefit of Korean Patent Application No. 10-2009-0025939, filed in Korea on Mar. 26, 2009, which is hereby incorporated by reference for all purposes as if fully set forth herein.

BACKGROUND OF THE INVENTION

1. Field of the Disclosure

The present invention relates to a driving method of a liquid crystal display device, and more particularly, to a black-data insertion driving method of a liquid crystal display device that improves brightness differences in an upper portion and middle/lower portions of a display panel.

2. Discussion of the Related Art

Recently, to improve image qualities and visual properties, various driving methods of a liquid crystal display (LCD) device have been suggested, and a black-data insertion driving method has been used as one of those driving methods.

FIG. 1 is a view of schematically illustrating an LCD device for a black-data insertion driving method according to the related art. FIG. 1 shows a liquid crystal panel 10, a timing control unit 20, a source driving unit 30, and a gate driving unit 40.

Referring to FIG. 2, which is a view of schematically illustrating a liquid crystal panel of FIG. 1, the liquid crystal panel 10 includes gate lines GL1 to GLn and data lines DL1 to DLm, which are formed on a substrate such as a glass substrate and cross each other to define pixel regions. A thin film transistor TFT and a liquid crystal capacitor $C_{LC}$ are formed at each pixel region, whereby an image is displayed by applied data through the pixel regions.

The timing control unit 20 may be referred to as a timing controller. The timing control unit 20 receives control signals and clock signals (CLKs) from the outer driving system such as TV or graphic cards and generates control signals for driving the source driving unit 30 and the gate driving unit 40. In addition, the timing control unit 20 provides RGB image data from the outer driving system to the source driving unit 30.

The source driving unit 30 includes a plurality of source drive integrated circuits, and the gate driving unit 40 includes a plurality of gate drive integrated circuits. The source driving unit 30 receives a plurality of gamma reference voltages and selects gamma reference voltages corresponding to the image data, responding the control signals inputted from the timing control unit 20. The source driving unit 30 generates data voltages Vdata according to the selected gamma reference voltages and provides the data voltages Vdata to the liquid crystal panel 2 to control rotation angles of liquid crystal molecules.

The gate driving unit 40 outputs gate driving signals Vg for controlling on/off of the thin film transistors TFTs arranged on the liquid crystal panel 10, responding the clock signals CLKs and the control signal inputted from the timing control unit 20. By sequentially enabling the gate lines GL1 to GLn on the liquid crystal panel 10, the thin film transistors TFTs on the liquid crystal panel 10 are sequentially driven line by line, and analog image signals from the source driving unit 30 are inputted to the pixels connected to the thin film transistors TFTs.

The gate driving signals Vg outputted from the gate driving unit 40, beneficially, are classified into an image-data gate driving signal Vg_D for inputting the image data and a black-data gate driving signal Vg_B for inputting black data. To do this, the gate driving unit 40 may be divided into an image-data gate driving unit and a black-data gate driving unit.

Referring to FIG. 3, a black-data insertion (BDI) driving method is to improve image qualities and visual properties of displayed images by defining a black area BA for inputting black data in a display area and moving the black area in the display area every frame.

FIG. 4 is a timing diagram of input data for explaining a black-data insertion (BDI) driving method according to the related art. FIG. 4 shows input timings of image data ID and black data BD at an (n−1)th frame and at an nth frame.

In FIG. 4, the image data ID is inputted with a positive (+) polarity at the (n−1)th frame and then is inputted with a negative (−) polarity at the nth frame due to a polarity inversion. The black data BD is inputted with a negative (−) polarity at the (n−1)th frame and then is inputted with a positive (+) polarity at the nth frame due to the polarity inversion.

Here, symbols t1, t2, t3 designate a blank interval of the image-data gate driving signal Vg_D, a blank interval of the black-data gate driving signal Vg_B, and a pattern change timing of a polarity inversion signal.

In the timing diagram, the black data BD of the negative (−) polarity is inputted to an upper portion of a display panel, which corresponds to an interval t4, at the end of the (n−1)th frame. Then, the image data ID of the negative (−) polarity is sequentially inputted from an upper portion of the display panel at the nth frame.

By the way, when the image data ID is inputted at the nth frame, the upper portion of the display panel, which corresponds to an interval t6, is the same as the upper portion of the display panel corresponding to the interval t4. The black data BD of the negative (−) polarity is inputted to the upper portion of the display panel at the (n−1)th frame, and the image data ID of the negative (−) polarity is inputted to the upper portion of the display panel at the nth frame. Accordingly, voltages of the same polarity are sequentially charged to the pixels, and this is a "strong" charge condition.

On the other hand, subsequently, the black data BD of the positive (+) polarity is inputted to an area corresponding to an interval t5, and then the image data ID of the negative (−) polarity is inputted to an area corresponding to an interval t7, which is the same as the area corresponding to the interval t5. Accordingly, voltages of different polarities are sequentially charges to the pixels, and this is a "weak" charge condition.

More particularly, the upper portion of the display panel, where the image data ID is inputted at the nth frame, has a "strong" charge condition due to the black data BD of the same polarity previously inputted, and other portions, that is, middle/lower portions of the display panel has a "weak" charge condition because the image data ID is inputted with the polarity opposite to the black data BD previously inputted. Therefore, The upper portion and the middle/lower portions of the display panel have a difference in brightness of a display image.

The brightness difference is caused by a change of signal levels of the polarity inversion signal, which is provided to the source driving unit 30 of FIG. 1 and enables an inversion driving. Referring to FIG. 5 showing signal level patterns of the polarity inversion signal POL, the pattern of the polarity inversion signal POL at the (n−1)th frame is inverted at the nth frame for the inversion driving. At this time, a pattern change point t3 of the polarity inversion signal POL is disposed in a section of outputting the back data gate driving signal Vg_B. Thus, since the black data BD and the image data ID are inputted with opposite polarities in the middle/lower portions of the display panel, the brightness difference is caused due to the "weak" charge of the image data ID.

SUMMARY OF THE INVENTION

Accordingly, the present invention is directed to a driving method of a liquid crystal display device that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

An object of the present invention is to provide a driving method of a liquid crystal display device that improves brightness differences in an upper portion and middle/lower portions of a display panel driven by a black-data insertion driving method and increases qualities of the liquid crystal display device.

To achieve these and other advantages and in accordance with the purpose of the present invention, as embodied and broadly described, a driving method of a liquid crystal display device includes steps of providing image data to a liquid crystal panel each frame, providing an image-data gate driving signal to the liquid crystal panel and inputting the image data to the liquid crystal panel, providing black data to the liquid crystal panel, providing a black-data gate driving signal to the liquid crystal panel and inputting the black data to the liquid crystal panel, and delaying the black-data gate driving signal when each frame starts.

It is to be understood that both the foregoing general description and the following detailed description of the present invention are exemplary and explanatory and are intended to provide further explanation of the invention as claimed. Other systems, methods, features and advantages will be, or will become, apparent to one with skill in the art upon examination of the following figures and detailed description. Nothing in this section should be taken as a limitation on those claims. Further aspects and advantages are discussed below in conjunction with the embodiments. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The system and/or method may be better understood with reference to the following drawings and description. Non-limiting and non-exhaustive embodiments are described with reference to the following drawings. The components in the figures are not necessarily to scale, emphasis instead being placed upon illustrating the principles of the invention. In the figures, like referenced numerals designate corresponding parts throughout the different views. The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to an embodiment of the present disclosure, an example of which is illustrated in the accompanying drawings.

Figure 6:
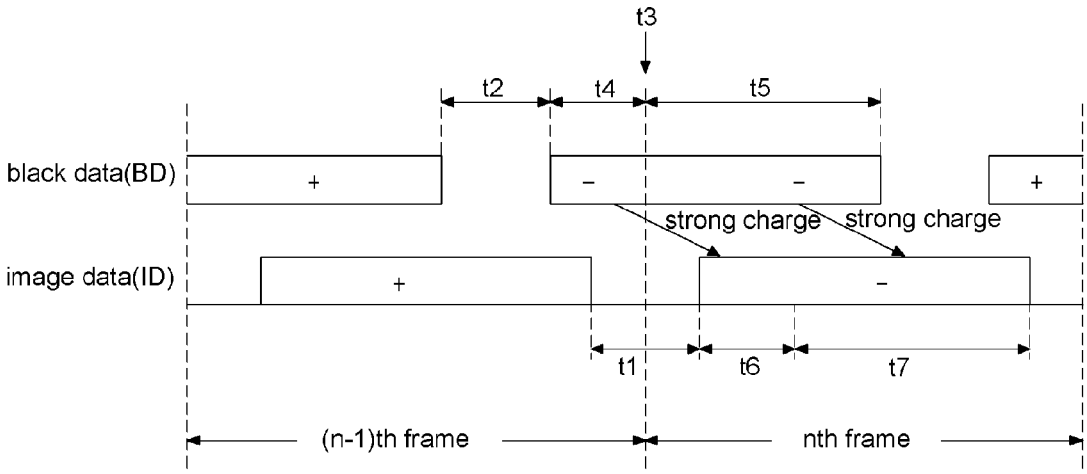
FIG. 6 is a timing diagram of input data for explaining a black-data insertion method of a liquid crystal display device according to an exemplary embodiment of the present invention.

FIG. 6 is a timing diagram of input data for explaining a black-data insertion method of a liquid crystal display device according to an exemplary embodiment of the present invention. FIG. 6 shows input timings of image data ID and black data BD supplied to a liquid crystal panel at an (n−1)th frame and at an nth frame in a liquid crystal display device driven by the black-data insertion method providing an additional gate driving signal for inputting the image data ID and the black data BD.

In FIG. 6, the image data ID is inputted with a positive (+) polarity at the (n−1)th frame and then is inputted with a negative (−) polarity at the nth frame due to a polarity inversion. The black data BD is inputted with a negative (−) polarity during an interval t4 at the (n−1)th frame and then is inputted with a negative (−) polarity during an interval t5 at the nth frame to make the "strong" charge condition of the image data ID.

That is, to get rid of the brightness difference in the liquid crystal panel, the charge condition of the image data ID should be uniform all over the liquid crystal panel. To do this, the black data BD and the image data having the same polarity are sequentially inputted to pixels of the liquid crystal panel, so that liquid crystal panel has the "strong" charge condition of the image data ID all over.

Here, symbols t1, t2, t3 designate a blank interval of an image-data gate driving signal Vg_D, a blank interval of a black-data gate driving signal Vg_B, and a pattern change timing of a polarity inversion signal, respectively.

To perform a driving method of FIG. 6 according to the present invention, it is controlled to input the black data BD to the liquid crystal panel by considering inversion properties of signal levels of the polarity inversion signal, which is provided for an inversion driving, each frame.

That is, the liquid crystal display device outputs gate driving signals Vg for controlling on/off of thin film transistors at the pixels arranged on the liquid crystal panel. Especially, the liquid crystal display device provides a black-data gate driving signal Vg_B for inputting black data and an image-data gate driving signal Vg_D for inputting the image data. At this time, an area of the liquid crystal panel where the black data BD is inputted can be adjusted for motion picture response time (MPRT) properties, and the black-data gate driving signal Vg_B and the image-data gate driving signal Vg_D have different initial input points.

In the present invention, by controlling the black-data gate driving signal Vg_B, which is provided in addition to the image-data gate driving signal Vg_D, the data input can be performed as shown in FIG. 6.

Figure 7:
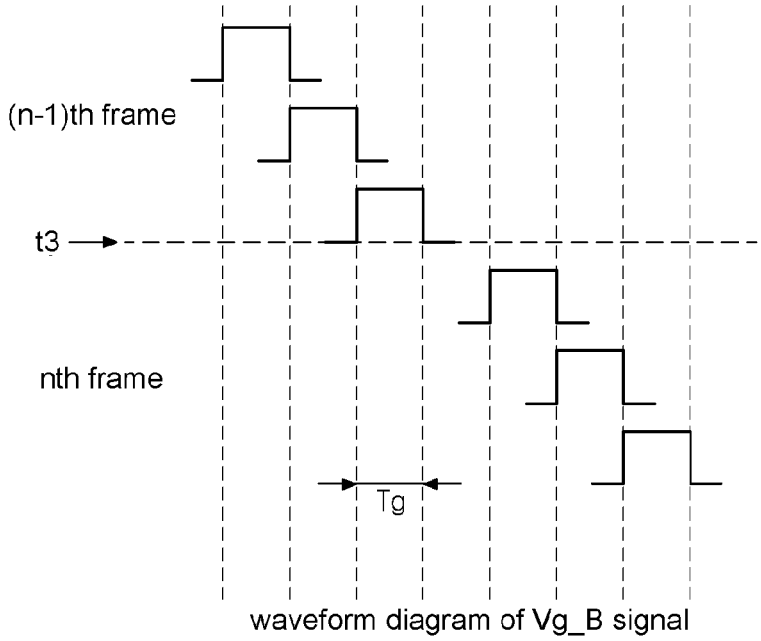
FIG. 7 is a waveform diagram of a black-data gate driving signal in a black-data insertion (BDI) driving method of a liquid crystal display device according to the present invention.

FIG. 7 is a waveform diagram of a black-data gate driving signal Vg_B in a black-data insertion (BDI) driving method of a liquid crystal display device according to the present invention.

In FIG. 7, to input the black data BD, the black-data gate driving signal Vg_B, which is sequentially outputted at the (n−1)th frame corresponding to the interval t4 of FIG. 6, is delayed with 1 gate driving signal input time Tg at the nth frame corresponding to the interval t5 of FIG. 6. This uses an inversion of the signal levels of the polarity inversion signal at the nth frame. When the black data BD is delayed and inputted by the 1 gate driving signal input time Tg, the black data BD inputted at the nth frame has the same polarity as the black data BD inputted at the (n−1)th frame regardless of the polarity inversion signal.

Figure 8:
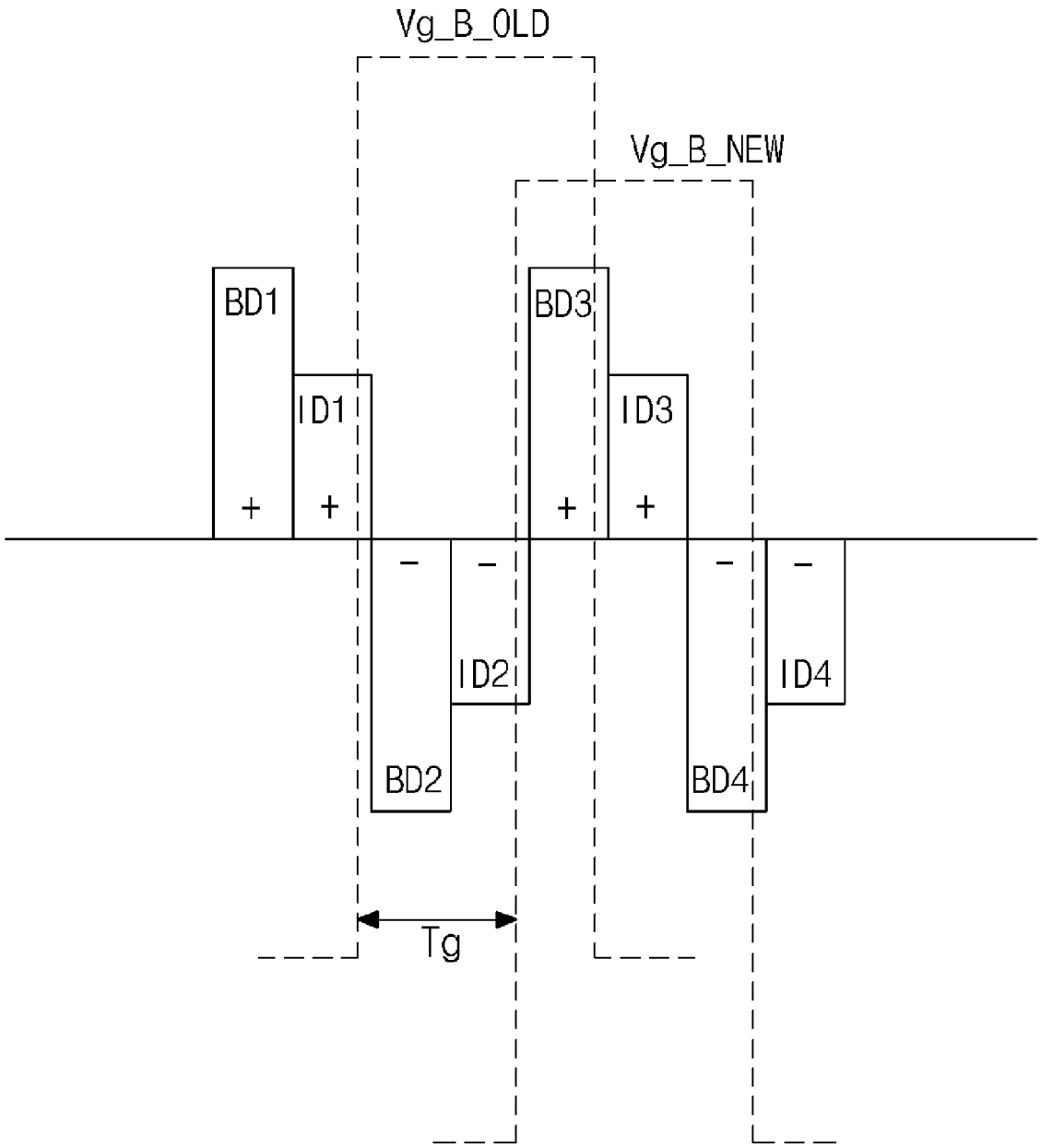
FIG. 8 is a view for explaining a delay effect of a black-data gate driving signal in a black-data insertion (BDI) driving method of a liquid crystal display device according to the present invention.

Referring to FIG. 8, if there is no delay, the black data BD3 having the positive (+) polarity is inputted according to the related art black data driving signal Vg_B_OLD when the nth frame starts. However, in the present invention, the black-data gate driving signal Vg_B_NEW is delayed and inputted by the 1 gate driving signal input time Tg, and the black data BD4 having the negative (−) polarity is inputted when the nth frame starts.

Accordingly, even though patterns of the polarity inversion signal are changed, the black data BD having the same polarity are inputted at the (n−1)th frame and the nth frame. Referring to FIG. 6, the "strong" charge condition is provided all over the image data ID, which is inputted with the negative (−) polarity at the nth frame. There is no brightness difference in the upper portion and the middle/lower portions of the display panel.

Figure 1A:
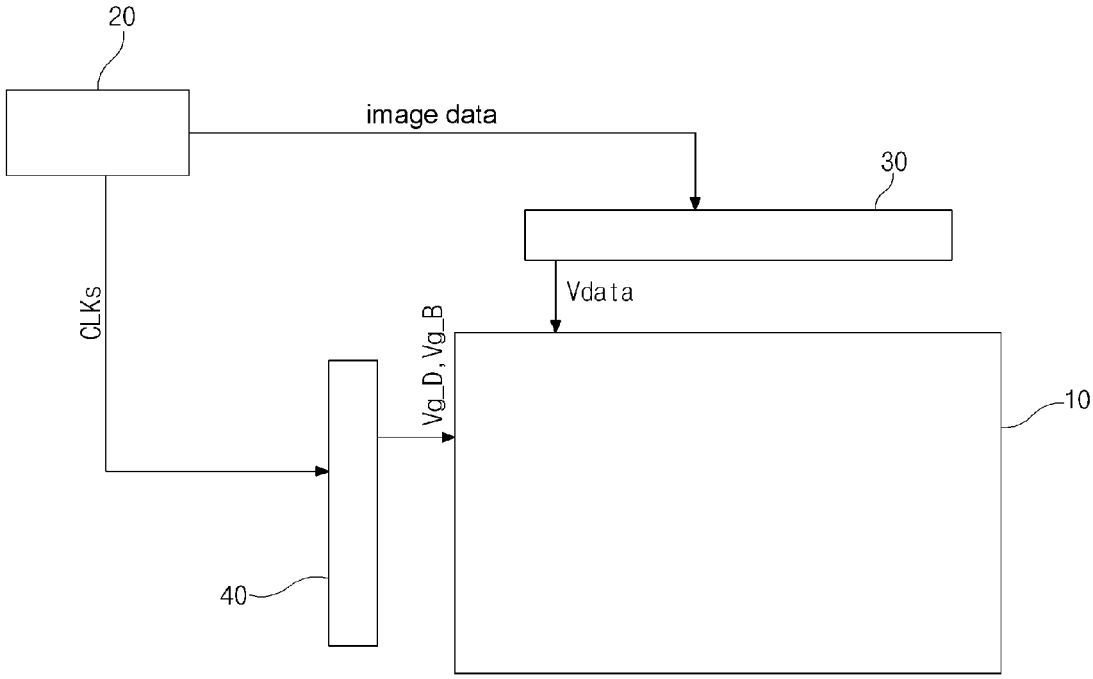
FIG. 1A RELATED ART
FIG. 1 is a view of schematically illustrating an LCD device for a black-data insertion driving method according to the related art.
Figure 2:
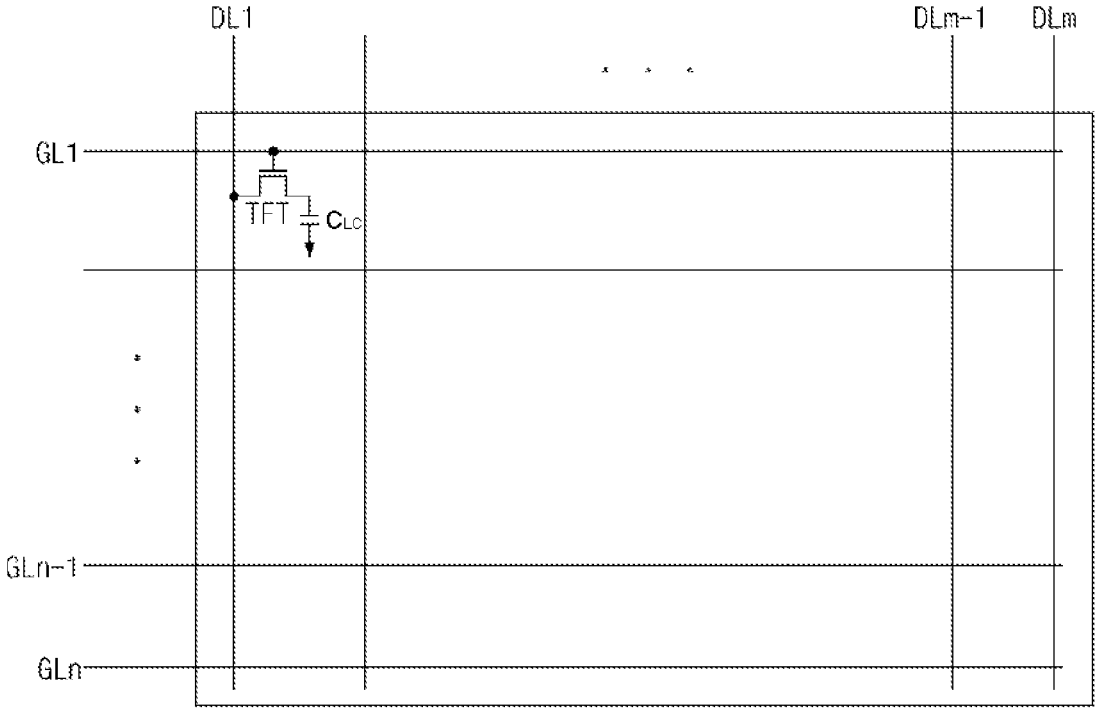
FIG. 2 RELATED ART
FIG. 2 is a view of schematically illustrating a liquid crystal panel of FIG. 1.
Figure 3:
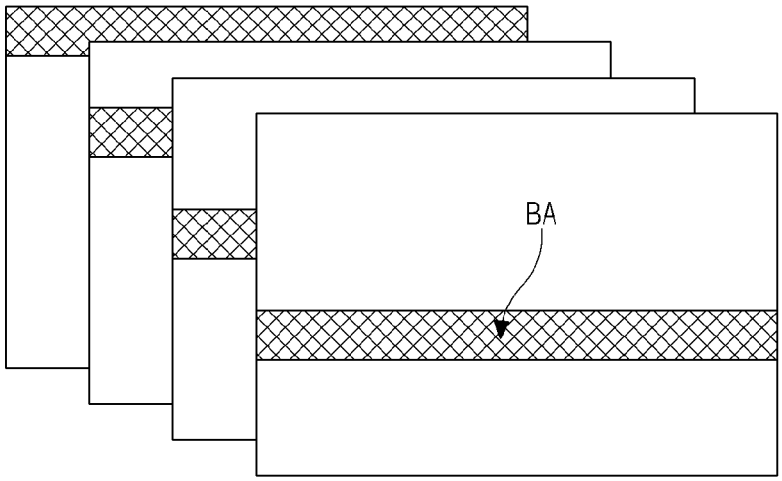
FIG. 3 RELATED ART
FIG. 3 is a view for explaining a black-data insertion driving method according to the related art.
Figure 4:
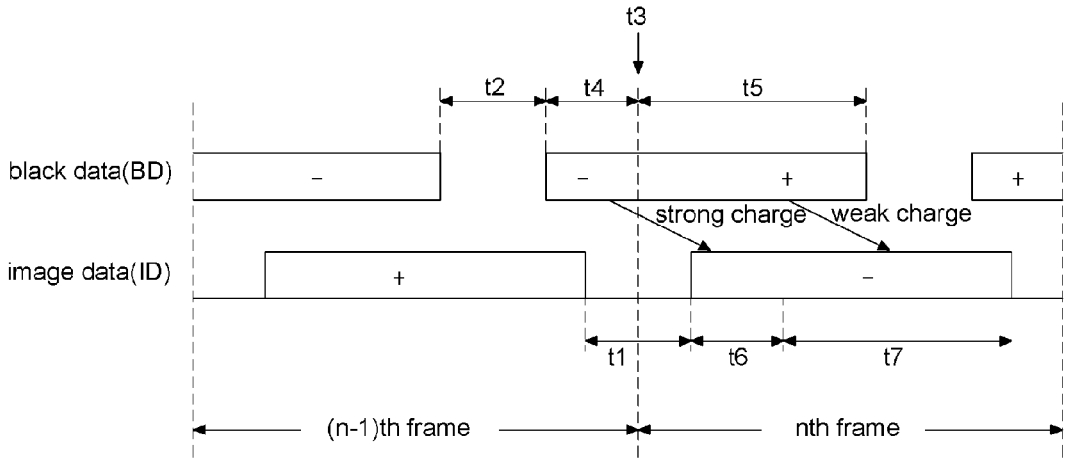
FIG. 4 RELATED ART
FIG. 4 is a timing diagram of input data for explaining a black-data insertion (BDI) driving method according to the related art.
Figure 5:
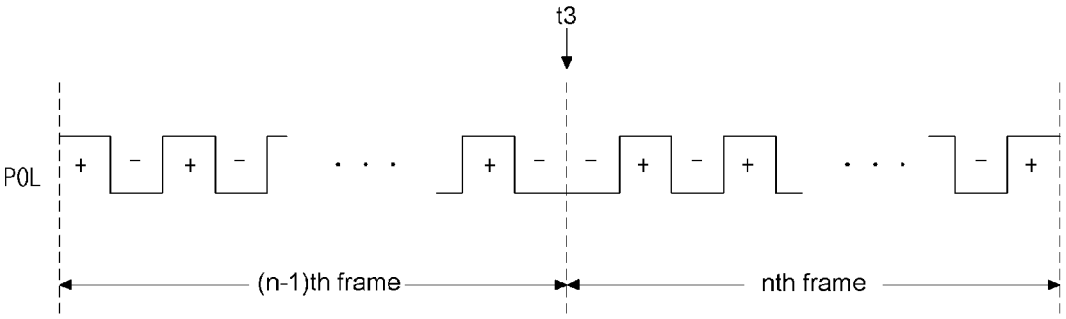
FIG. 5 RELATED ART
FIG. 5 is a waveform diagram for explaining pattern changes of the polarity inversion signal according to the related art.

Meanwhile, in FIG. 7 and FIG. 8, the delay time of the black-data gate driving signal Vg_B is the 1 gate driving signal input time Tg, and this is applied to an 1-dot inversion driving. The delay time of the black-data gate driving signal Vg_B may vary. For example, in a 2-dot inversion driving, the delay time may be 2 gate driving signal input time 2Tg. In addition, the gate driving signal may be delayed by controlling gate shift clock (GSC), which is provided to the gate driving unit 40 of FIG. 1 from the timing control unit 20 of FIG. 1 in order to generate gate driving signals. In a gate-in-panel type display device, the gate driving signal may be delayed by controlling the clock signals CLKs, which are provided to the gate driving unit 40 of FIG. 1 in order to generate the gate driving signals.

In the present invention, the display device is driven by the black-data insertion driving method, and the gate driving signals for inputting the image data and the black data are separately provided. Images are stably displayed without the brightness difference all over the display panel.

It will be apparent to those skilled in the art that various modifications and variations can be made in the present invention without departing from the spirit or scope of the invention. The illustrations of the embodiment described herein are intended to provide a general understanding of the structure of the various embodiments. The illustrations are not intended to serve as a complete description of all of the elements and features of systems that utilize the methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized Accordingly, the disclosure and the figures are to be regarded as illustrative rather than restrictive. The above disclosed subject matter is to be considered illustrative, and not restrictive, and the appended claims are intended to cover all such modifications, enhancements, and other embodiments, which fall within the true spirit and scope of the present invention.

What is claimed is:

1. A driving method of a liquid crystal display device, the method comprising:

providing image data to a liquid crystal panel including m gate lines, where m is a natural number, each frame;

providing an image-data gate driving signal to the liquid crystal panel and inputting the image data to the liquid crystal panel;

providing black data to the liquid crystal panel;

providing a black-data gate driving signal to the liquid crystal panel and inputting the black data to the liquid crystal panel; and delaying the black-data gate driving signal when each frame starts, wherein the liquid crystal panel is driven by an n-dot inversion method in which every n pixels have opposite polarities, where n is a natural number, wherein the black-data gate driving signal is delayed by n gate driving signal input time, and wherein there is a time interval of the n gate driving input time between the black-data gate driving signal applied to the $m^{th}$ gate line in a frame and the back-data gate driving signal applied to the first gate line in a next frame.

2. The method according to claim 1, wherein the black-data gate driving signal and the image-data gate driving signal have different input intervals.

3. The method according to claim 2, wherein the black-data gate driving signal and the image-data gate driving signal have different initial input points.

4. The method according to claim 1, further comprising a step of providing a polarity inversion signal each frame to invert polarities of the image data and the black data each frame.

5. The method according to claim 4, wherein the polarity inversion signal has signal levels that are inverted each frame.

6. The method according to claim 1, wherein:

the liquid crystal panel is driven by an 1-dot inversion method in which every pixel has opposite polarities; and the black-data gate driving signal is delayed by 1 gate driving signal input time.

7. The method according to claim 1, wherein:

the liquid crystal panel is driven by a 2-dot inversion method in which every two pixels have opposite polarities; and the black-data gate driving signal is delayed by 2 gate driving signal input time.

8. The method according to claim 1, wherein the black data and the image data having the same polarity are sequentially inputted to pixels of the liquid crystal panel.

* * * * *